US006039583A

United States Patent [19]

Korsunsky et al.

[11] Patent Number: 6,039,583

[45] Date of Patent: Mar. 21, 2000

[54] CONFIGURABLE GROUND PLANE

[75] Inventors: Iosif Korsunsky, Harrisburg; Dimitry Grabbe, Middletown; Alex Hasircoglu, Columbia; Richard Schroepfer, Thompsontown; Daniel Robert Ringler, Elizabethville, all of Pa.

[73] Assignee: The Whitaker Corporation, Wilmington, Del.

[21] Appl. No.: 09/040,680

[22] Filed: Mar. 18, 1998

[51] Int. Cl.[7] ..... H01R 4/66

[52] U.S. Cl. ..... 439/101; 439/607

[58] Field of Search ..... 439/79, 80, 83, 439/607–8, 629–30, 108–9, 100–101, 892, 149–150

[56] References Cited

U.S. PATENT DOCUMENTS

| | | | |
|---|---|---|---|
| 4,232,929 | 11/1980 | Zobawa . | |
| 4,914,062 | 4/1990 | Voltz . | |
| 5,013,262 | 5/1991 | Shibano | 439/610 |
| 5,219,295 | 6/1993 | Niwa et al. . | |
| 5,433,618 | 7/1995 | Morlion et al. | 439/108 |
| 5,470,259 | 11/1995 | Kaufman et al. | 439/607 |
| 5,533,901 | 7/1996 | Hunt et al. . | |
| 5,607,326 | 3/1997 | McNamara et al. | 439/608 |
| 5,672,064 | 9/1997 | Provencher et al. . | |
| 5,797,770 | 8/1998 | Davis et al. | 439/607 |

*Primary Examiner*—Lincoln Donovan

[57] ABSTRACT

An electrical connector 10 having a configurable ground plane 60 is provided. The connector 10 features an insulative housing 20 having an upright section 30 and a board receiving section 28. The board receiving section has open top and bottom outer surfaces 29, 27 for allowing insertion of contacts 50, 52 into contact receiving passages 34, 32. The ground plane 60 is disposed over the top set of contacts 50 and is profiled to engage selected ones of the contacts 50 in the upright section of the passages 34. The ground plane 60 is configurable in that it can be easily adapted to achieve various signal to ground contact ratios by locating contacts 92, 94 at selected positions on fingers 88 which extend into the upright section of the passages 34.

8 Claims, 4 Drawing Sheets

CONFIGURABLE GROUND PLANE

FIELD OF THE INVENTION

This invention is related to electrical connectors and more particularly to a ground plane for a circuit board receiving connector.

BACKGROUND OF THE INVENTION

In computer and other applications, it is commonly necessary to form a plurality of electrical connections between two printed circuit boards. These connections can be achieved through an interface between an edge of one printed circuit board and an electrical connector mounted on the other printed circuit board. Each application requires a certain orientation of the boards relative to each other. For example, the application may require that the boards be positioned perpendicular to each other. Other applications may require the boards to be positioned parallel to each other. One way to achieve a parallel interface is to mount a right angle electrical connector on a printed circuit board which receives the edge of the other board.

One such example is shown in U.S. Pat. No. 5,219,295. That patent teaches a high density electrical connector having a housing with contacts arranged in rows to engage a printed circuit board. The housing supports the contacts in a right angle orientation. Another example of such a right angle connection is shown in U.S. Pat. No. 5,533,901. That patent teaches an electrical connector having a housing which supports multiple electrical contacts each having terminals which are profiled to be mounted to a printed circuit board at a right angle.

As microprocessor clock speeds and signal speeds continue to rise there is an ever increasing need for better signal isolation in small electrical connectors. This is typically achieved by use of a ground plane adjacent to the signal contacts in the connector.

In some interconnection arrangements such as the arrangements described above a problem exists in the it is often difficult to have the ground plane extend over the entire length of the signal contacts. This is desirable because it minimizes the signal to ground distance and therefore gives better signal isolation. Depending on the signal speed of each application, different ratios of signal to ground contacts are desirable to achieve proper isolation and acceptable electrical performance. A problem exists with current designs in that once a connector is manufactured with a specified signal to ground contact ratio, that ratio can not be changed without redesigning the housing, contacts and ground plane.

It is therefore desirable to have a connection system design that would allow flexibility in creating different signal to ground contact ratios.

SUMMARY

It is therefore an object of the present invention to address the above mentioned problems by providing a simplified electrical connector arrangement which allows for design flexibility in creating different signal to ground contact ratios.

This and other objects have been achieved by providing a configurable ground plane having a top surface and a plurality of fingers extending from the top surface. The plurality of fingers are profiled to enter contact receiving cavities and to engage selected contacts and a back wall of the cavities.

BRIEF DESCRIPTION OF THE DRAWINGS

The invention will now be described by way of example with reference to be accompanying figures of which.

DETAILED DESCRIPTION OF THE EMBODIMENT

Figure 1:
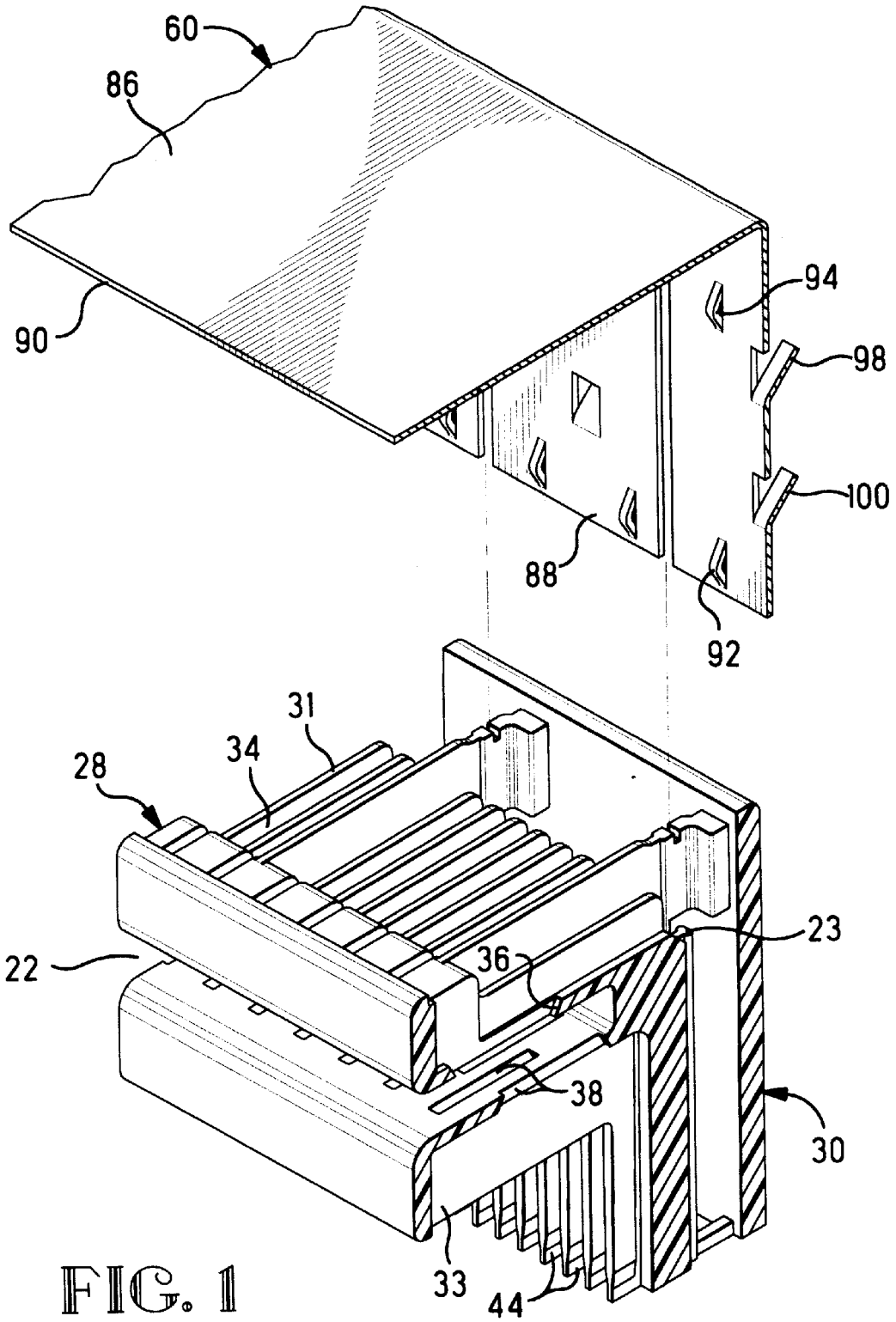
FIG. 1 shows an exploded three dimensional view of a ground plane over a connector housing according to the present invention.

The invention will first be described generally with reference to FIG. 1. This figure shows a cross sectional view of the electrical connector 10 according to the present invention. The electrical connector 10 features an insulative housing 20 having an upright section 30 and a board receiving section 28 which extends substantially perpendicular from the upright section 30. The board receiving section 28 has a mating end 24 and a board receiving opening 22 which extends inward from the mating end 24 and across substantially the entire length of the board receiving section 28. A set of top contact receiving passages 34 extends from the board receiving section 28 through the upright section 30. Similarly, a set of bottom contact receiving passages 32 extend from the board receiving section 28 through the upright section 30. A first set of top contacts 50 (FIG. 4) are disposed in the top contact receiving passages 34. Similarly, a set of bottom contacts 52 (FIG. 4) are disposed in the bottom contact receiving passages 32. A ground plane 60 is disposed over the top contacts 50 and inside the upright portion of the contact receiving passage 34.

Each of the major components will now be described in greater detail. First, the housing 20 will be described in greater detail with reference to FIGS. 1 and 4. Beginning with FIG. 1, it can be seen that the insulative housing 20 has a board receiving opening 22 which extends along a board receiving end 24. A plurality of stand offs 42 (FIG. 4) are disposed at side ends of the insulative housing 20 and optionally at selected locations along the length. The upright section 30 contains an upright portion 44 of each bottom contact passage 32. The upright portions 44 of these passages 32 extend from the board mounting face 26 to the board receiving section 28.

Each of the bottom contact receiving passages 32 are profiled to have openings 38 which are staggered with respect to each other across the housing length. For example, beginning at the sectioned portion of FIG. 1, the first opening 38 is positioned toward the upright section 30 and the next opening 38 is positioned toward the mating end 24 of the board receiving section 28. The-contacts 50, 52 are positioned in this staggered back and fourth arrangement across the entire housing 20. Similarly, the top set of contact receiving passages 34 are staggered from the upright section 30 to the mating end 24 of the board receiving section 28. It should also be noted here that the top and bottom set of contact receiving passages 34, 32 and openings 36, 38 are staggered opposite to each other. Therefore, as viewed in the cross sectional view of FIG. 4, it can be seen that the top contact receiving passage opening 36 is positioned toward the upright section 30 and the bottom contact receiving passage opening 38 is positioned opposite that of the top contact receiving passage 34 and toward the mating end 24.

Figure 2:
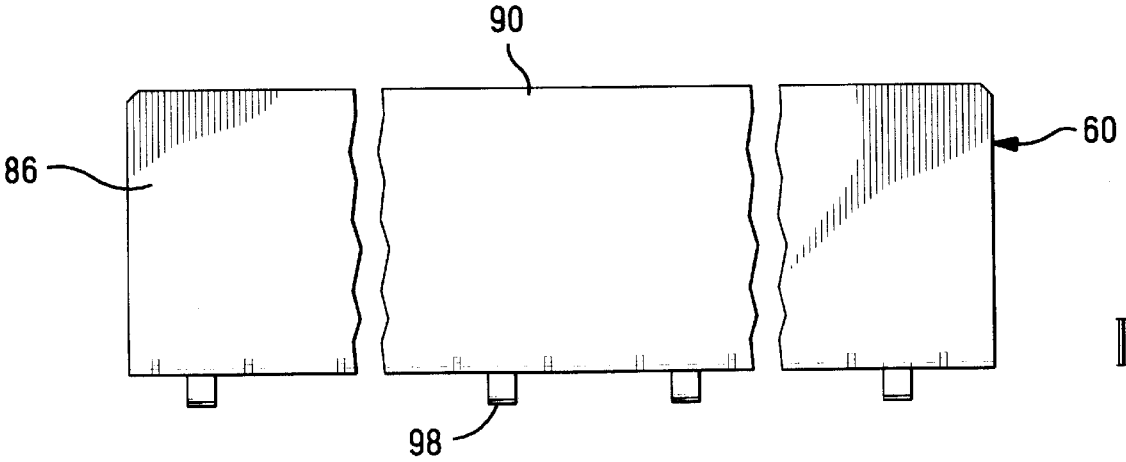
FIG. 2 shows a top side view of the ground plane of FIG. 1.
Figure 4:
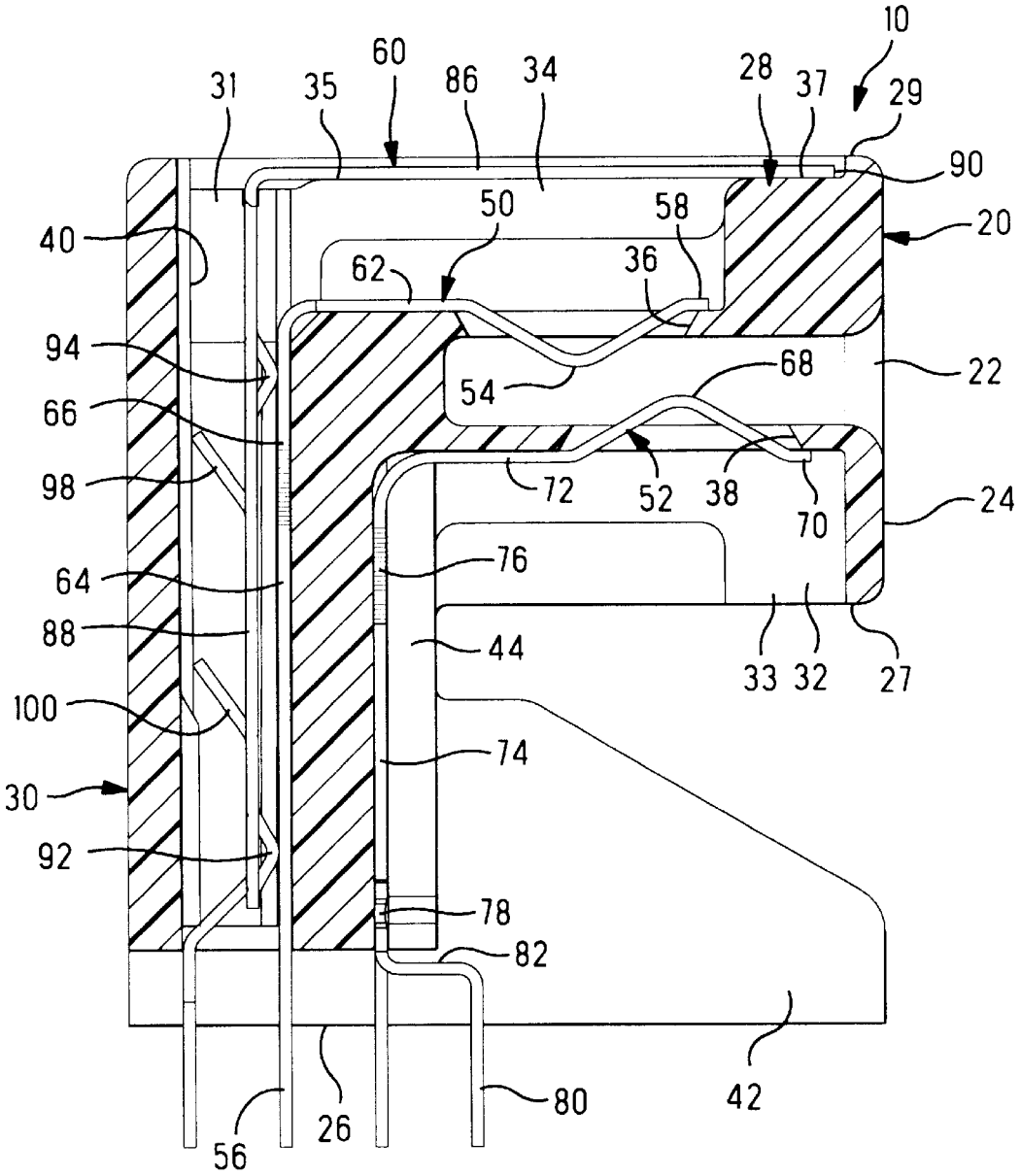
FIG. 4 shows a cross sectional view of an assembled electrical connector and ground plane of FIG. 1 including contacts.

Each of the top and bottom contact receiving passages 34, 32 are open to the board receiving opening 22 through the openings 36, 38 described above. The top contact receiving passages 34 are also open to a top outer surface 29 of the board receiving section 28. The top contact receiving passages 34 also extend into the upright section 30 and have a back wall 40. As best seen in FIG. 2 the upright portions of each top contact receiving passage 34 is separated by a T-shaped wall 23. The T-shaped wall 23 serves to capture an upright portion 64 as shown in FIG. 4 of the contact 50 as will be further described below. Similarly, each of the bottom contact receiving passages 32 opens into the board receiving opening 22 through opening 38. These contact receiving passages 32 are also open to the bottom outer surface 27 of the board receiving section 28. The bottom contact receiving passageways 32 also extend into the upright section 30.

Figure 3:
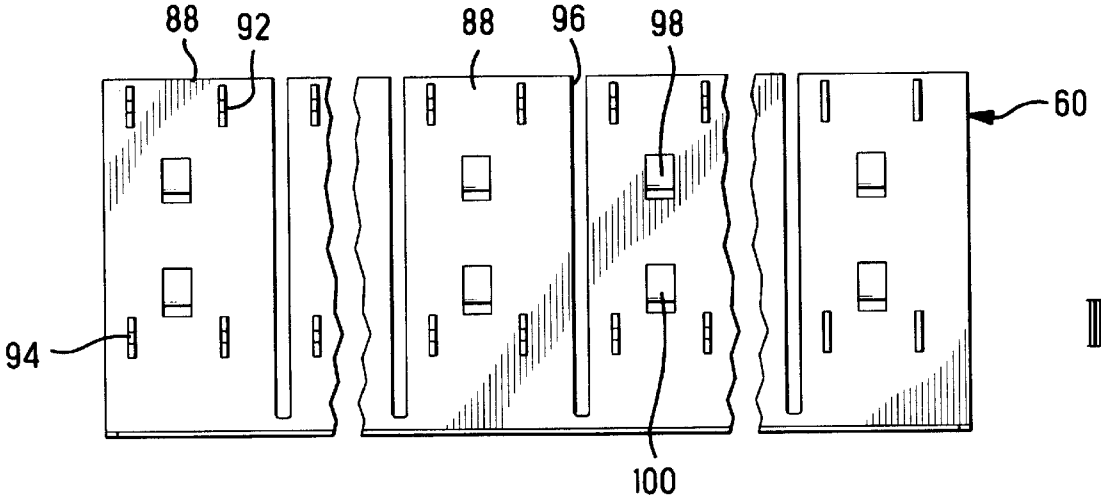
FIG. 3 shows a left side view of the ground plane of FIG. 1.

A ledge 37 is disposed along the top surface 29 near the tab receiving slot 23. A plurality of walls 31 as shown in FIG. 4 are disposed each between selected adjacent contact receiving passages 34. These walls 31 extend from the transition between the upright and board receiving sections 30 and 28 through the board receiving section 28. Selected ones of the walls 31, are profiled to extend to the plane of the ledges 37. Similarly, a plurality of walls 33 and 44 as shown in FIG. 3 are disposed between each of the contact receiving passages 32 and 34, respectively.

The contacts 50, 52 will now be described in greater detail with reference to FIG. 4. First, The top set of contacts 50 will be described. A board engaging portion 54 extends from a free end 58 and is formed in a top arm 62. An upright arm 64 extends from the top arm 62 at a right angle. A terminal portion 56 extends from the upright arm 64 at a free end. Barbs 66 extend from side edges of the upright arm portion 64. Similarly, the bottom set of contacts 52 feature a board engaging portion 68 extending from a free end 70 along a top arm 72. An upright arm 74 extends from the top arm 72 at a right angle. Barbs 76 extend from side edges of the upright arm portion 74. Terminal portion 80 extends from the upright arm portion 74. It should be noted here that a jog 82 is formed in the upright portion 74. A similar jog may be formed in the top set of contacts 50 depending on its position in the housing as was described above.

The ground plane 60 will now be described in greater detail with reference to FIG. 10. The ground plane 60 consists of a top surface 86 which is generally planar and a plurality of fingers 80 which extend from the top surface 86 at approximately a right angle. The top surface 86 has a free end 90. Each finger 88 will now be described in greater detail with reference to FIGS. 1 and 5. Contacts 92, 94 are preferably drawn from each finger 88. It should be understood that these contacts 92, 94 may be simply lanced or alternatively may be drawn as shown by FIG. 1. These contacts 92, 94 are preferably drawn from the fingers 88 in a direction toward the free end 90. Therefore a contact point is formed between a pair of ends which are attached to the finger 88. A series of securing lances 98, 100 are formed from each finger 88. These securing lances 98, 100 are formed in a direction opposite to the contacts 92, 94. A slot 96 is formed between each set of adjacent fingers 88. The ground plane 60 is formed of a conductive material, preferably low carbon steel. Alternatively, any conductive material could be used to form the ground 60.

Figure 5:
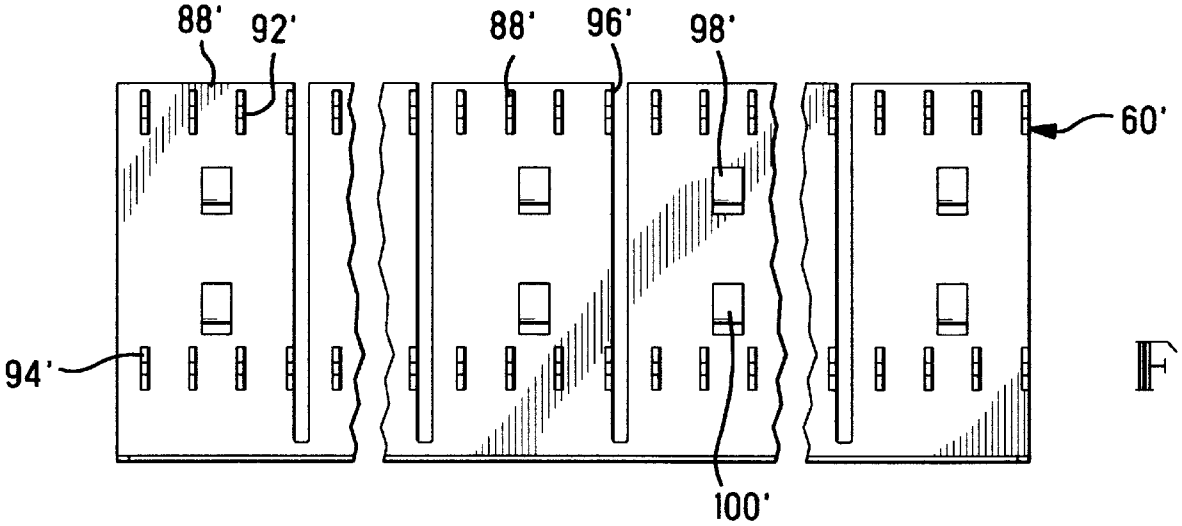
FIG. 5 shows a left side view similar to FIG. 3 of a first alternate ground plane.
Figure 6:
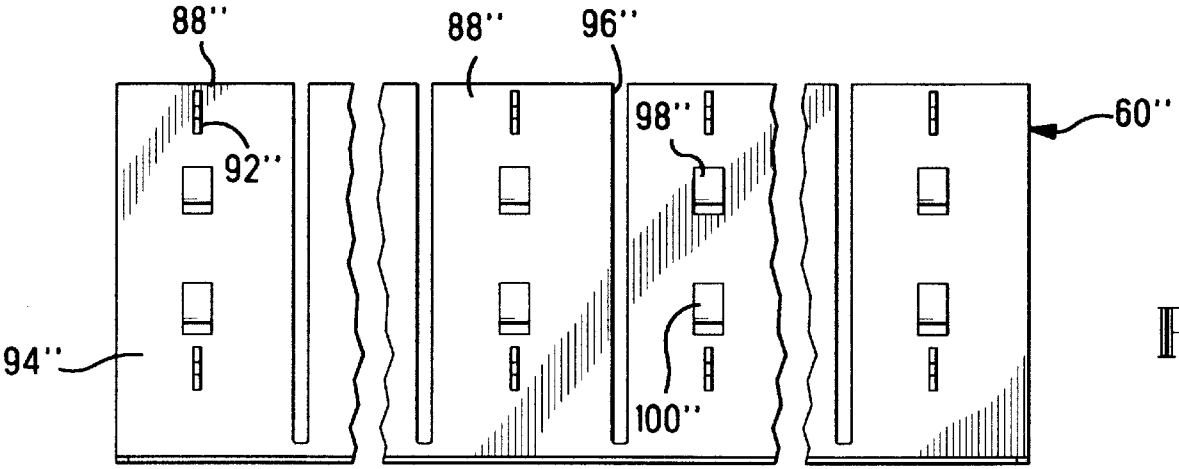
FIG. 6 shows a left side view similar to FIGS. 3 and 5 of a second alternate ground plane.

Alternate embodiments of the ground plane are shown in FIGS. 5 and 6. The fingers 88', 88" can be configured to achieve varying signal to ground pin ratios. For example the embodiment of FIGS. 1–4 show a ground plane 60 having fingers 88 which are dimensioned to cover eight contacts 50. Two of the eight covered contacts 50 will be grounded through contacts 92, 94 of the ground plane. This achieves a signal to ground contact ratio of 4 to 1.

The first alternate embodiment shown in FIG. 5 features a ground plane 60' having a plurality of fingers 88' each dimensioned to cover eight contacts 50. However, here, the contacts 92', 94' are formed and positioned to engage or ground four of the eight contacts 50. Also, the securing lances 98', 100' are relocated to balance the normal forces applied on the four engaged contacts 50. This achieves a signal to ground contact ratio of 1 to 1.

The second alternate embodiment shown in FIG. 6 features a ground plane 60" having a plurality of fingers 88" each dimensioned to cover eight contacts 50. However, here, the contacts 92", 94" are formed and positioned to engage or ground one of the eight contacts 50. Also, the securing lances 98', 100' are relocated to balance the normal forces applied on the four engaged contacts 50. This achieves a signal to ground contact ratio of 7 to 1.

It should be noted here that the contacts 92, 94 can be positioned to achieve other signal to ground ratios. Also, the finger 88 dimension could be changed to cover more or less than eight contacts. Depending on the number of covered contacts, the housing 20 may have to be modified to accommodate the ground plane 60. For example, because selected walls 31 extend up to the ledge 37 to fit into the spaces formed between fingers 88, these walls 31 may have to be relocated to accommodate different sized fingers 88. The preferred embodiment shows fingers dimensioned to cover eight contacts because it gives increased flexibility in adjusting the signal to ground ratio without any modifications to the housing walls 31.

Assembly of the major components will now be described in greater detail. First, contacts 50 are insertable into the contact receiving passages 34 such that the upright sections 64 fit between the T-shaped walls 23 and barbs 66 engage sides of the T-shaped walls 23. Next, the bottom row of contacts 52 are similarly inserted into the contact receiving passages 32 such that barbs 76 engage side walls of each passage 32 to secure the contacts therein. Once the contacts 50, 52 are secured in position, each of the board engaging portions 44, 68 will pass through openings 36, 38 into the board receiving opening 22 and the terminal sections 56, 80 will extend beyond the mounting face 26. Finally, the ground plane 60 is inserted into the top contact receiving passages 34 such that securing lances 98, 100 engage the back wall 40 of the contact receiving passages 34 in the upright section 30. The securing lances 66, 100 serve to urge the finger 88 into engagement with selected contacts 50 at the contacts 94, 92. It should also be noted here referring to FIGS. 1 and 3 that walls 31 of the housing 20 will fit between the fingers 88 into slots 96.

It should be understood here that while the ground plane 60 is shown here to function as an electrical commoning member to connect selected contacts 50 to a ground connection on the printed circuit board, it could be used to common other signals as well. For example, it could be utilized to common a plurality of power signals among selected contacts 50 or alternatively, any signal could be commonly applied to the selected contacts 50 through this commoning technique. It should also be understood here that while the invention is embodied here in a right angle electrical connector, these concepts are equally applicable to other angular orientations. For example this invention is applicable to 45 degree and other angular orientations.

An advantage of the present invention is that the ground plane 60 can be easily configured to achieve various signal to ground contact ratios with out any modification to the housing 20 or overall dimensions of the ground plane 60. Thus the electrical performance characteristics of the connector can be easily adjusted for various applications.

We claim:

1. An electrical connector comprising:

a housing, a unitary ground plane extending in the housing, and first contacts in first passages in the housing, the first contacts comprising a number of signal contacts and a number of ground contacts according to a desired ratio of signal contacts to ground contacts, the unitary ground plane having projecting unitary contacts engaging selected ones of the first contacts in the first passages to provide said number of ground contacts according to said desired ratio of signal contacts to ground contacts, the unitary ground plane extending beside said number of signal contacts in the first passages and providing shielding for said number of signal contacts in said first passages, and the unitary ground plane having projecting unitary lances engaging the housing and urging the unitary ground plane toward the first contacts in the first passages, whereby the unitary ground plane is urged with the unitary contacts to engage the selected ones of the first contacts in the first passages.

2. An electrical connector as recited in claim 1 wherein, a portion of the unitary ground plane extends at an angle, and said portion of the unitary ground plane has a planar surface over an outer surface of the housing.

3. An electrical connector as recited in claim 1 wherein, a portion of the unitary ground plane extends at an angle, said portion of the unitary ground plane has a planar surface over an outer surface of the housing, portions of the first passages are open to the outer surface of the housing, and portions of the first contacts extend along said portions of the first passages that are open to the outer surface of the housing.

4. An electrical connector as recited in claim 2 wherein, walls on the housing extend in spaces between the fingers.

5. An electrical connector as recited in claim 1 wherein, the ground plane is divided into fingers, each of the fingers covers a desired number of the first contacts, the unitary contacts are on the fingers and engage selected ones of the desired number of the first contacts, the unitary contacts are spaced apart from each other and are spaced from the lances, the lances are located centrally on the fingers and are spaced from the unitary contacts to balance forces being applied by the unitary contacts on the selected ones of the desired number of the first contacts.

6. An electrical connector as recited in claim 5 wherein, each of the fingers covers a desired number of eight of the first contacts, and the unitary contacts on each finger engage a selected two of the desired number of eight of the first contacts, providing a desired ratio of signal contacts to ground contacts that equals 4:1.

7. An electrical connector as recited in claim 5 wherein, each of the fingers covers a desired number of eight of the first contacts, and the unitary contacts on each finger engage a selected four of the desired number of eight of the first contacts, providing a desired ratio of signal contacts to ground contacts that equals 1:1.

8. An electrical connector as recited in claim 5 wherein, each of the fingers covers a desired number of eight of the first contacts, and the unitary contacts on each finger engage a selected one of the desired number of eight of the first contacts, providing a desired ratio of signal contacts to ground contacts that equals 7:1.

* * * * *